US010716419B1

(12) United States Patent
Johnson

(10) Patent No.: US 10,716,419 B1
(45) Date of Patent: Jul. 21, 2020

(54) CUPS HAVING TRANSPARENT AND GRAPHIC AREAS THAT DISPLAY A COMPOSITE IMAGE WHEN STACKED

(71) Applicant: CHURCHILL CONTAINER, LLC, Fenton, MO (US)

(72) Inventor: Erik Christopher Johnson, Shawnee, KS (US)

(73) Assignee: CHURCHILL CONTAINER, LLC, Fenton, MO (US)

( * ) Notice: Subject to any disclaimer, the term of this patent is extended or adjusted under 35 U.S.C. 154(b) by 0 days.

(21) Appl. No.: 16/519,847

(22) Filed: Jul. 23, 2019

(51) Int. Cl.
*A47G 19/22* (2006.01)
*A47G 19/23* (2006.01)
*B65D 85/00* (2006.01)

(52) U.S. Cl.
CPC ..... *A47G 19/2227* (2013.01); *A47G 19/23* (2013.01); *B65D 85/00* (2013.01)

(58) Field of Classification Search
CPC .... A47G 19/22; A47G 19/2227; A47G 19/23; B65D 1/16; B65D 21/02; B65D 85/00
USPC ..... 206/217, 459.1, 459.5
See application file for complete search history.

(56) References Cited

U.S. PATENT DOCUMENTS 3,456,860 A 7/1969 Janninck
5,125,512 A * 6/1992 O'Leary ..... B65D 21/0233 206/517
6,065,603 A * 5/2000 Filice ..... A47G 19/23 206/217
6,718,664 B2 * 4/2004 Williams ..... B29C 45/14336 40/324

(Continued)

OTHER PUBLICATIONS

StockX Web page for "Supreme Stacking Cups (Set of 4) Red", downloaded from the internet on Jan. 9, 2020 at https://stockx.com/supreme-stacking-cups-set-of-4-red (1 pg).

(Continued)

*Primary Examiner* — Bryon P Gehman
(74) *Attorney, Agent, or Firm* — Stinson LLP

(57) ABSTRACT

The present invention is directed to a cup having a sidewall with transparent and graphic areas that display at least one image in a composite form when a second identical cup is stacked within the first cup in a specific orientation. The sidewall has at least two sections, each extending vertically from an upper portion to a lower portion of the sidewall. The first section includes at least one graphic area with a corresponding transparent area positioned adjacent to and above the graphic area. The second section includes at least one graphic area. The graphic area in the first section consists of a lower part of an image and the graphic area in the second section includes an upper part of the image. The transparent area is sized and shaped to match that of the graphic area in the second section and is positioned at a higher location along the sidewall than that of the graphic area of the second section. When a second identical cup is received within the first cup and rotated such that the first section of the first cup aligns and is overlapping the second section of the second cup, the upper part of the image contained within the graphic area of the second section of the second cup can be seen through the transparent are of the first cup. In this manner, the upper and lower parts of the image are displayed together in composite form.

11 Claims, 7 Drawing Sheets

(56) References Cited

U.S. PATENT DOCUMENTS

| | | | | |
|---|---|---|---|---|
| 7,806,296 | B2 * | 10/2010 | Connors | B65D 81/363<br>222/78 |
| 8,714,348 | B2 * | 5/2014 | Vargas | A47G 19/2227<br>206/217 |
| 10,479,544 | B2 * | 11/2019 | Crosby | B65D 25/205 |

OTHER PUBLICATIONS

BuyBuy Baby Web page for "Bright Starts™ Oscar the Grouch's Stacking Cans™ Stackable Cups", downloaded from the internet on Jan. 9, 2020 at https://www.buybuybaby.com/store/product/bright-starts-oscar-the-grouch-39-s-stacking-cans-stackable-cups/5389935_ (3 pgs).

* cited by examiner

CUPS HAVING TRANSPARENT AND GRAPHIC AREAS THAT DISPLAY A COMPOSITE IMAGE WHEN STACKED

BACKGROUND OF THE INVENTION

1. Field of the Invention

The present invention is directed to the field of decorative drinking cups and is more specifically directed to a cup having transparent and graphic areas positioned on the sidewall of the cup such that a composite image is displayed when a second cup is stacked or seated within the cup in a specific orientation.

2. Description of Background Art

It is well known in the art to make decorative cups from a variety of materials, such as paper or plastic wherein the cups can be stacked, one seated within the other, for storage and dispensing. These cups commonly include a decorative image consisting of text and/or graphics printed on or otherwise incorporated into the sidewall of the cup such as via offset printing, in-mold labeling, or other techniques known in the art.

BRIEF SUMMARY OF THE INVENTION

The present invention is directed to a cup having a sidewall with transparent and graphic areas that display at least one image in a composite form when a second identical cup is stacked within the first cup in a specific orientation. The sidewall has at least two sections, each extending vertically from an upper portion to a lower portion of the sidewall. The first section includes at least one graphic area with a corresponding transparent area positioned adjacent to and above the graphic area. The second section includes at least one graphic area. The graphic area in the first section consists of a lower part of an image and the graphic area in the second section consists of an upper part of the image. The transparent area is sized and shaped to match that of the graphic area in the second section and is positioned at a higher location along the sidewall than that of the graphic area of the second section. When a second identical cup is received within the first cup and rotated such that the first section of the first cup aligns and is overlapping the second section of the second cup, the upper part of the image contained within the graphic area of the second section of the second cup can be seen through the transparent area of the first cup. In this manner, the upper and lower parts of the image are displayed together in composite form.

In certain embodiments, the sidewall of the cup defines a cavity configured to receive the second identical cup in a stacked configuration with the bottom of the second cup sidewall positioned a displacement distance above the bottom of the first cup sidewall. In this stacked configuration, all of the first cup sidewall (except for a bottom portion approximately equal to the displacement distance) overlaps all of the second cup sidewall (except for a top portion equal to the displacement distance). In these embodiments, the transparent area of the first section is positioned higher than the graphic area of the second section a distance that is approximately the same distance as the displacement distance between the sidewalls of the first and second cups when stacked. Thus, when a second cup is received within the first cup and rotated such that the first section of the first cup aligns and is overlapping the second section of the second cup, the transparent portion of the first cup is overlapping the graphic area of the second section of the second cup so that the graphic area can is visible through the transparent portion.

In certain embodiments, the first section includes a plurality of first section graphic areas extending one above the other and a plurality of first section transparent areas extending adjacent to and above a corresponding one of the first section graphic areas. The second section also includes a plurality of second section graphic areas. Each second section graphic area is positioned on the sidewall at a distance below a corresponding one of the transparent areas in the first section a distance that is approximately equal to the displacement distance between the sidewalls of the first and second cups when stacked. In the embodiments including a plurality of graphic areas in the first and second sections, the at least one image to be displayed in composite form is divided into horizontally oriented parts extending across the image positioned one above the other. Each of the parts of the image are alternatingly included in the first and second section graphic areas. Specifically, the lowermost graphic area of the first section includes the bottom part of the image and each of the remaining graphic areas of the first section includes a corresponding one of every other one of the parts of the image. Similarly, the lowermost graphic area of the second section includes the part immediately above the bottom part of the image and each of the remaining graphic areas of the second section includes a corresponding one of every other one of the parts of the image. In certain of these embodiments, the graphic areas and transparent areas each have a height approximately equal to the displacement distance between the sidewalls of first and second cups when stacked.

In certain embodiments, the cup includes graphic and transparent areas that display a first image in composite form on the first half of the sidewall and that display a second image in composite form on the second half of the sidewall. In this embodiment, the sidewall has a first half section and a second half section, each of which extends from the top to the bottom of the sidewall. Each half section includes a graphic area with a transparent area positioned adjacent and above the graphic area. The graphic area of the first half section includes the design of the lower part of the first image. The graphic area of the second half section includes a design that is both an upper part of the first image and a lower part of the second image. The design and transparent areas each have the same shape and size and each have a height that is approximately the same distance as the displacement distance between the sidewalls of the first and second cups when they are stacked together. When the second cup is positioned within the first cup in the stacked configuration, and rotated such that the second half section of the second cup is aligned and overlapping with the first half section of the first cup, the graphic areas of the second cup are visible through the transparent areas of the first cup so as to form composite images with the graphic areas of the first cup.

In certain embodiments, the first half section includes a plurality of first half section graphic areas extending one above the other with a plurality of first half section transparent areas extending adjacent to and above corresponding first half section graphic areas. In certain embodiments, the second half section also includes a plurality of second half section graphic areas extending one above the other along the second half section with a plurality of second half section transparent areas extending adjacent to and above corresponding second half section graphic areas. In certain embodiments, each one of the plurality of first half section graphic areas are positioned on the sidewall the same vertical distance from the bottom of the sidewall as a corresponding one of the second half section graphic areas.

In certain embodiments, two images to be displayed in composite form are each divided into horizontally oriented parts extending across each image so as to have a plurality of parts, one positioned above the other for each image. Alternating parts of the first image are included in the plurality of graphic areas in the first section and the second section respectively. Specifically, the lowermost graphic area of the first section includes the bottom part of the image and each of the remaining graphic areas of the first section includes a corresponding one of every other one of the parts of the first image. Similarly, the lowermost graphic area of the second section includes the part immediately above the bottom part of the image and each of the remaining graphic areas of the second section includes a corresponding one of every other one of the parts of the first image. In certain embodiments, some of the parts of the first image have an identical design to some of the parts of the second image, but the parts of the first and second images that have the same designs are positioned at different locations in the first and second images. In certain embodiments, the parts of the first and second images that have the same designs, are positioned in locations in the first and second images a distance apart approximately equal to the displacement distance between the sidewalls of the first and second cups when stacked. In certain embodiments, the plurality of graphic areas and transparent areas each have a height approximately equal to the displacement distance between the sidewalls of first and second cups when stacked.

In certain embodiments, each graphic area in the first half section abuts at each end a corresponding graphic area in the second half section to form a circumferential ring extending transversely around the sidewall. In certain embodiments, each transparent area in the first half section abuts at each end a corresponding transparent area in the second half section to form a circumferential ring extending around the sidewall. In certain embodiments, each of said plurality of circumferential graphic rings and circumferential transparent rings have a height approximately equal to said displacement distance.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
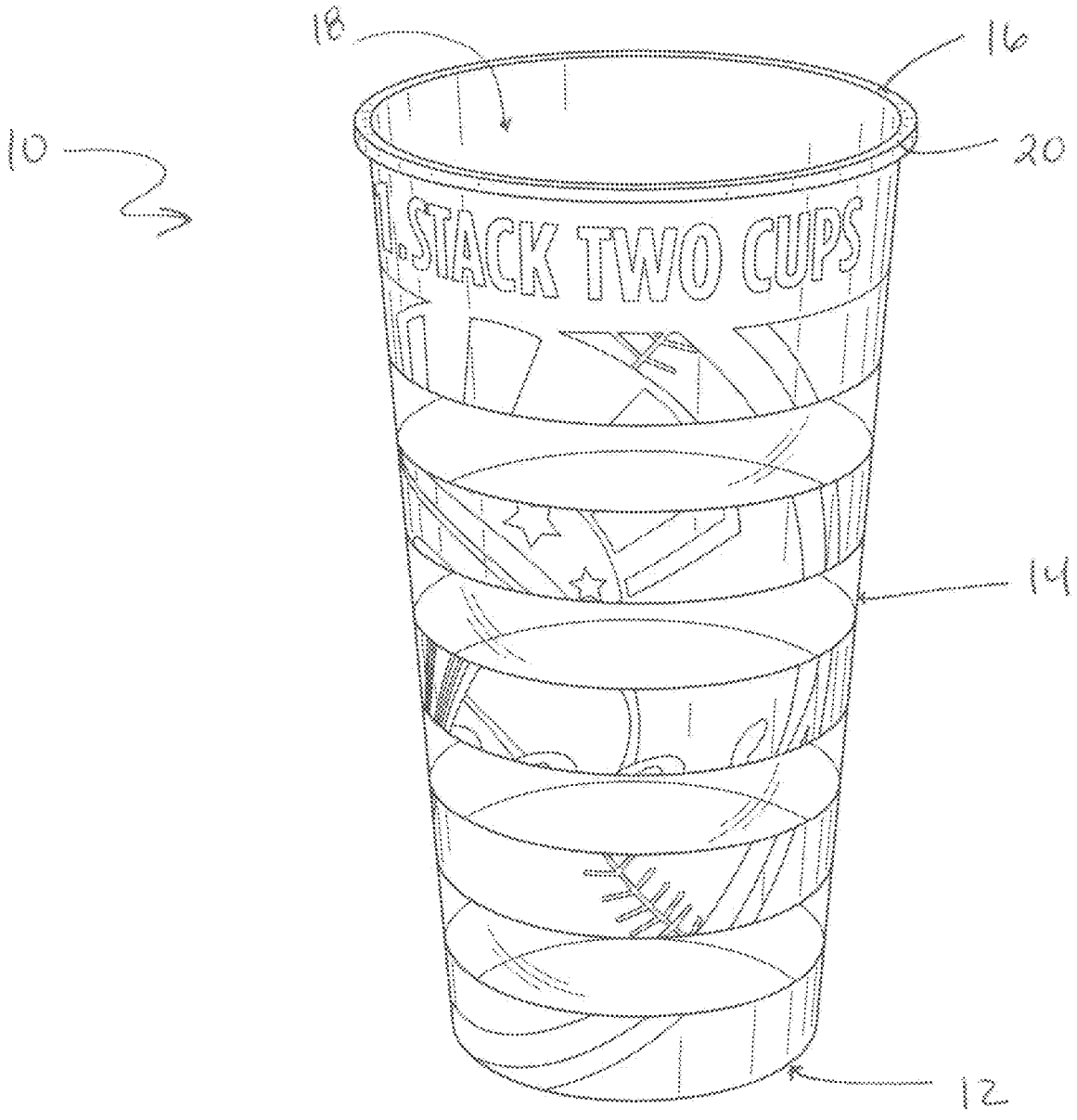
FIG. 1 is a perspective view of a decorative cup in accordance with an exemplary embodiment of the present invention.
Figure 2:
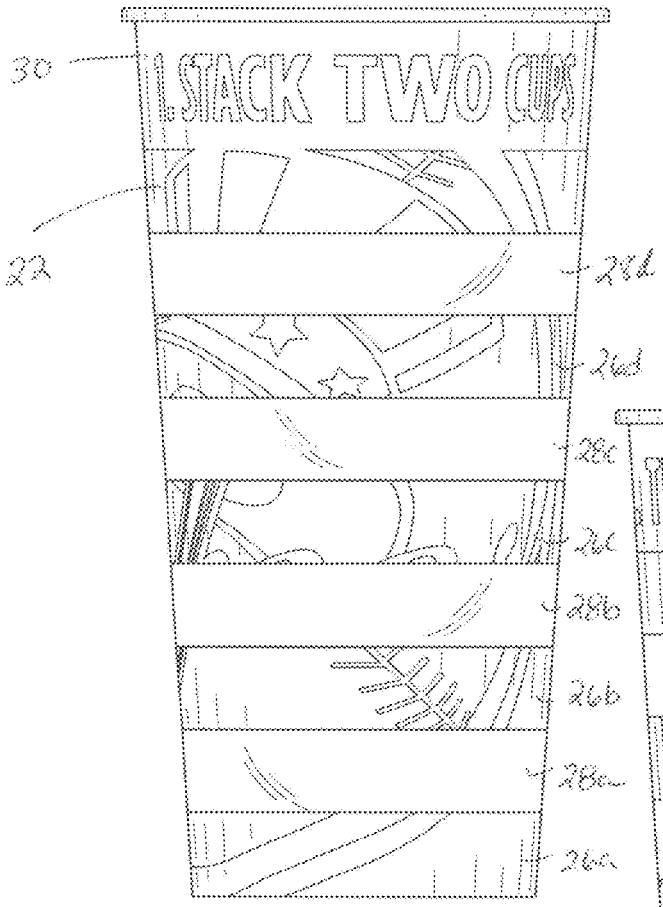
FIG. 2 is a front plan view of the cup of FIG. 1.
Figure 3:
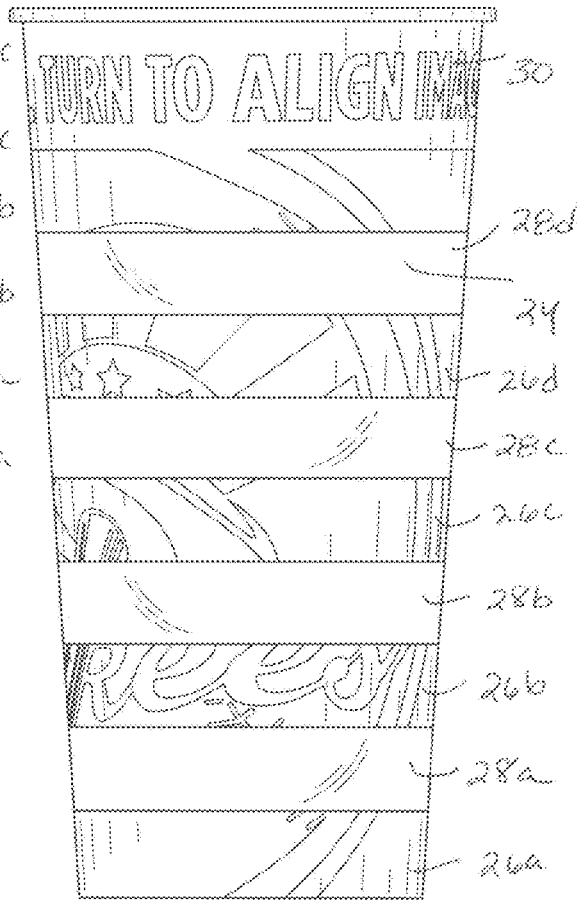
FIG. 3 is rear plan view of the cup of FIG. 1.
Figure 4:
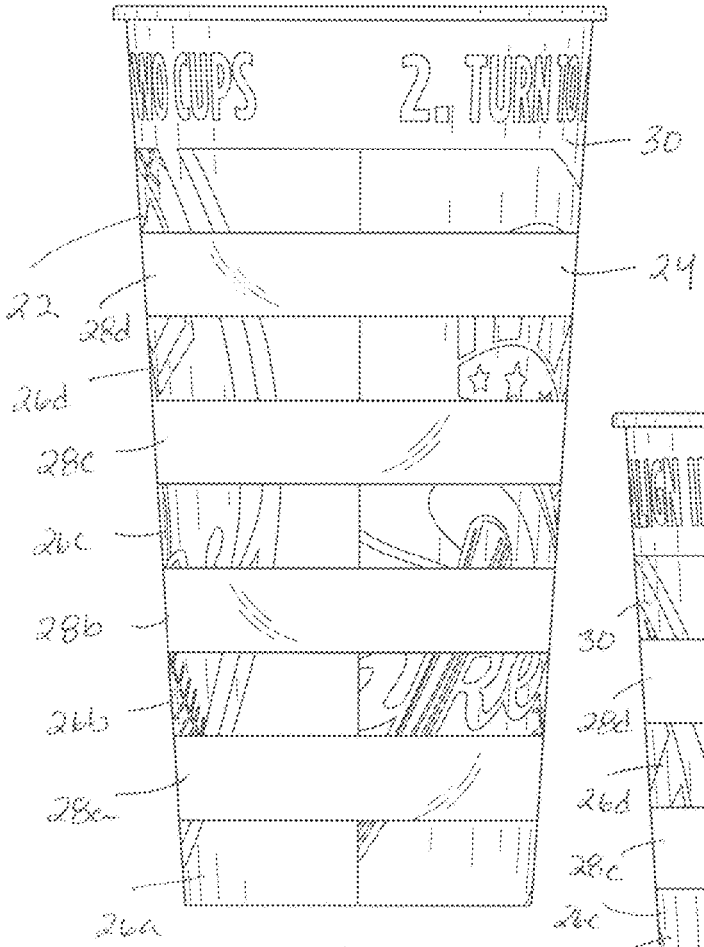
FIG. 4 is a right side plan view of the cup of FIG. 1.
Figure 5:
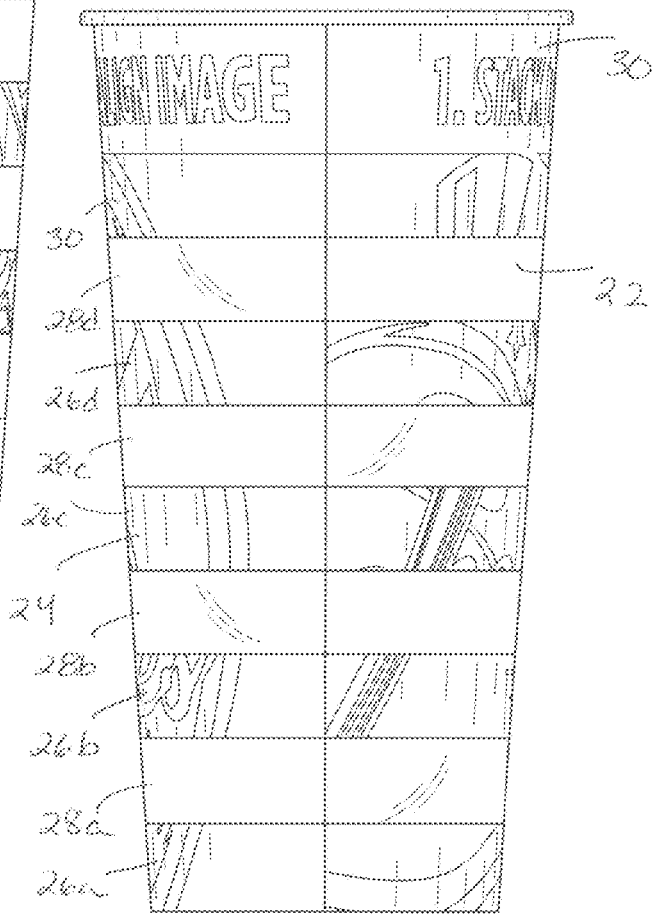
FIG. 5 is a left side plan view of the cup of FIG. 1.
Figure 6:
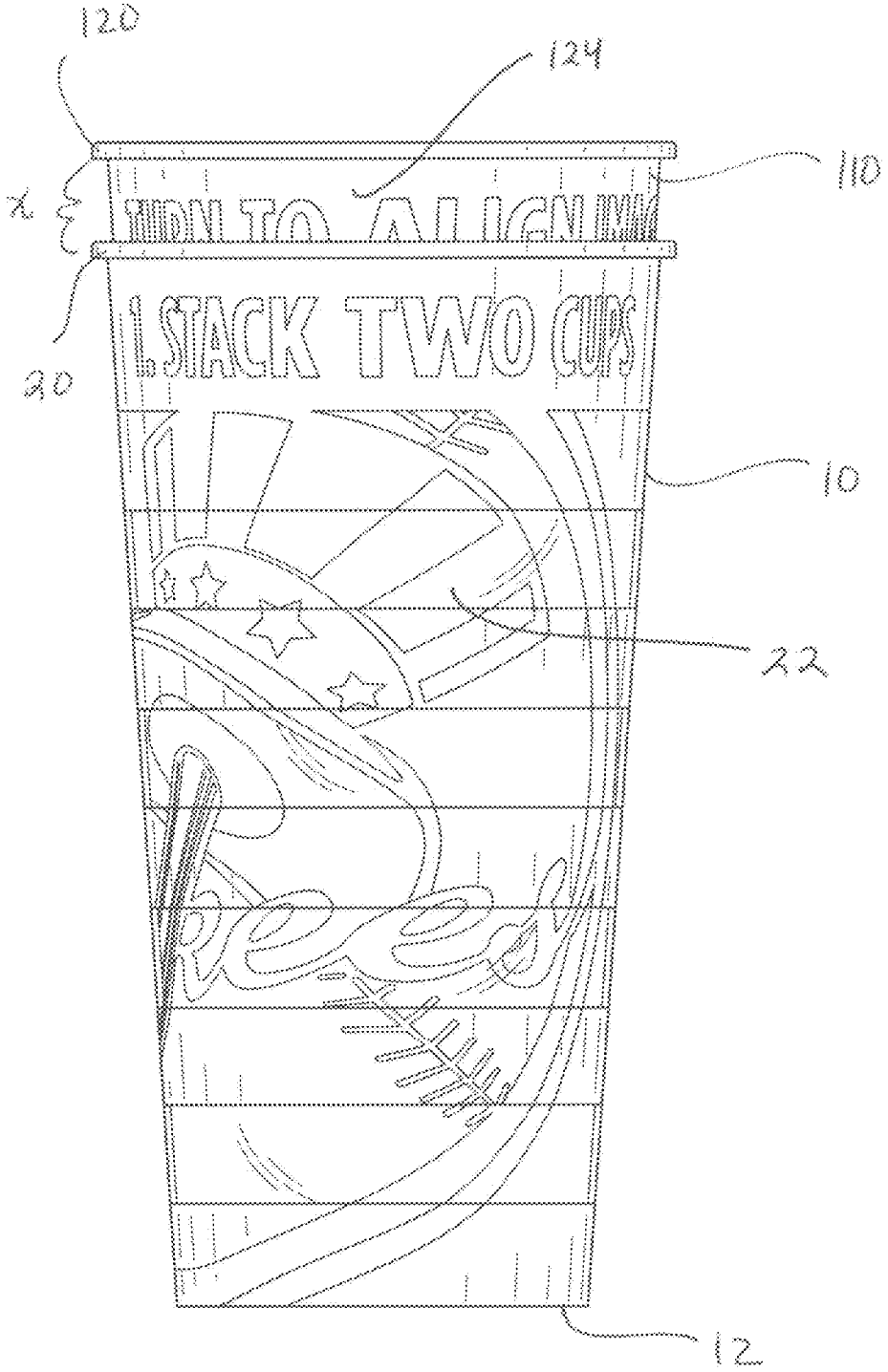
FIG. 6 is a plan view showing two of the cups of FIG. 1 in a stacked orientation with the cups turned relative to one another such that the front side of the bottom cup is aligned with the rear side of the top cup to display a composite image.

A cup in accordance with an exemplary embodiment of the present invention is depicted in the Figures and generally designated by the numeral 10. Cup 10 has a circular closed bottom 12 with an upstanding sidewall 14 that extends at a slight taper from an open top 16 to the outer perimeter of bottom 12. Bottom 12 and sidewall 14 together define a generally cylindrical cavity 18 in which a variety of drinking liquids, food products, or other items can be retained. Upper rim 20 extends outward from the top edge of sidewall 14 to surround open top 16. As best seen in FIG. 6, cup 10 is configured such that a second identical cup 110 can be seated within cavity 18 in a stacked configuration as is known in the art. The slightly tapered angle of sidewall 14 preferably ranging from 1 to 5 degrees inhibits second cup 110 from extending all the way down into cup 10 to rest on bottom 12. Instead, the bottom of second cup 110 is positioned a displacement distance x above bottom 12 of cup 10 such that the upper rim 120 of the second cup is positioned above upper rim 20 of cup 10. In this manner, the cups are more easily removed from one another by holding the upper rim 120 of the second cup (either by hand or via a dispenser) and pulling the bottom of the first cup 10.

While cup 10 is circular with a cylindrical shape in the exemplary embodiment, it should be understood that it can have a different cross-sectional configuration, including without limitation oval, square, rectangular and star-shaped configurations without departing from the invention. In addition, the relative dimensions of the sidewall 14 and bottom 12 can vary to provide cups having a profile ranging from tall and thin to short and wide without departing from the invention.

As best shown in FIGS. 2-5, sidewall 14 is divided along the longitudinal axis of the cup into a front half 22 and a rear half 24. Circumferential design rings 26*a*, 26*b*, 26*c*, 26*d* extend transversely around sidewall 14 spaced apart from one another by circumferential transparent rings 28*a*, 28*b*, 28*c*, 28*d* that each extend transversely around sidewall 14 immediately adjacent and above corresponding graphic rings 26*a*, 26*b*, 26*c*, 26*d*. Graphic rings 26*a*, 26*b*, 26*c*, 26*d* and transparent rings 28*a*, 28*b*, 28*c*, 28*d* have a generally uniform height as measured from the bottom edge to the top edge of each respective ring. This uniform height is approximately equal the displacement distance x between second cup 110 and first cup 10 when second cup 110 is received and seated within first cup 10 in the stacked configuration. The lowermost graphic ring 26*a* extends along the bottom edge of sidewall 14 and the uppermost transparent ring 28*d* extends proximate open top 16, with the other graphic rings 26*b*, 26*c*, 26*d* and transparent rings 28*a*, 28*b*, 28*c* positioned in alternating fashion one above the other between lowermost graphic ring 26*a* and uppermost transparent ring 28*d*. Circumferential design border 30 extends transversely around sidewall 14 between uppermost transparent ring 28*d* and rim 20.

Figure 7:
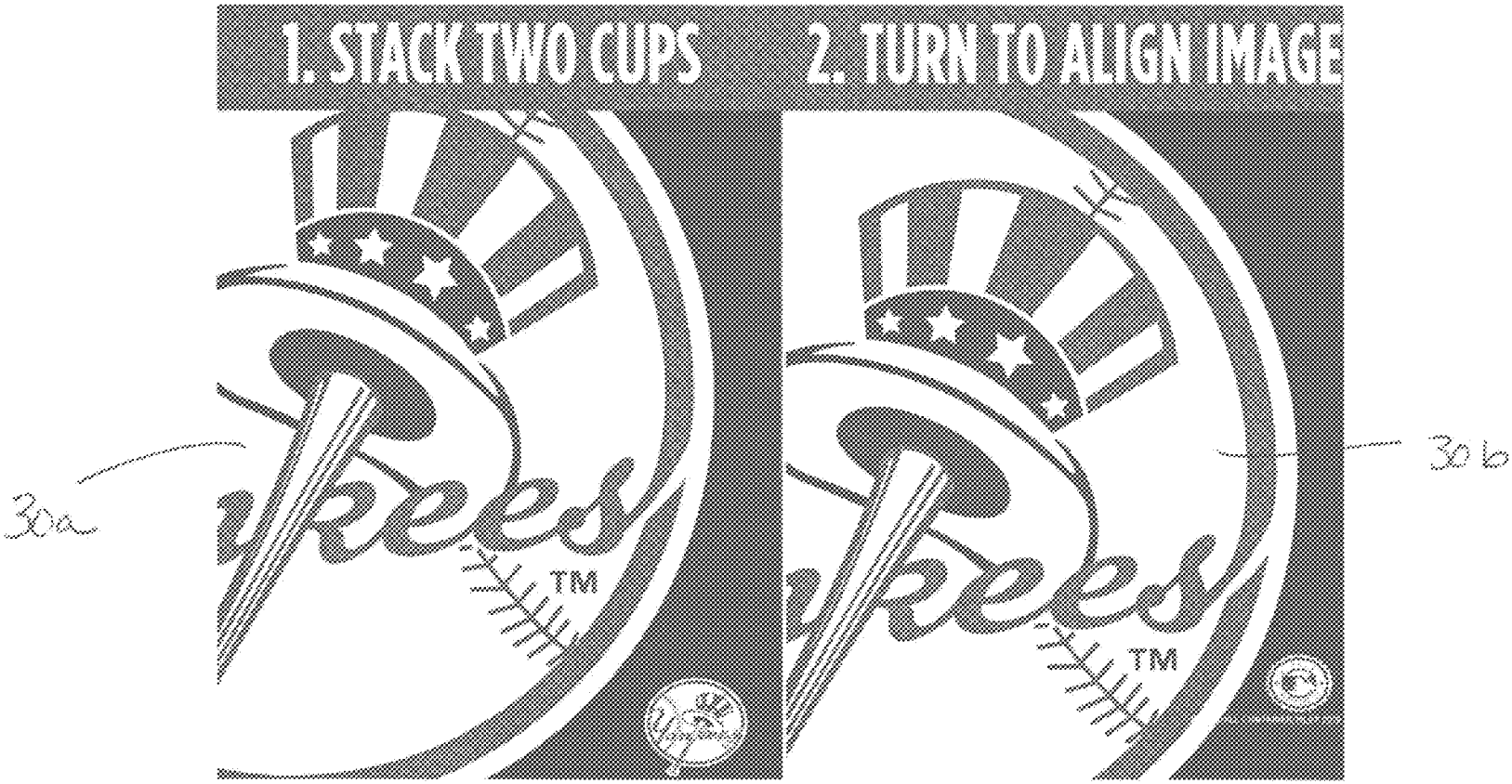
FIG. 7 is a 2D depiction of the complete image that is displayed in composite form when two of the cups of FIG. 1 are in the stacked orientation of FIG. 6.
Figure 8:
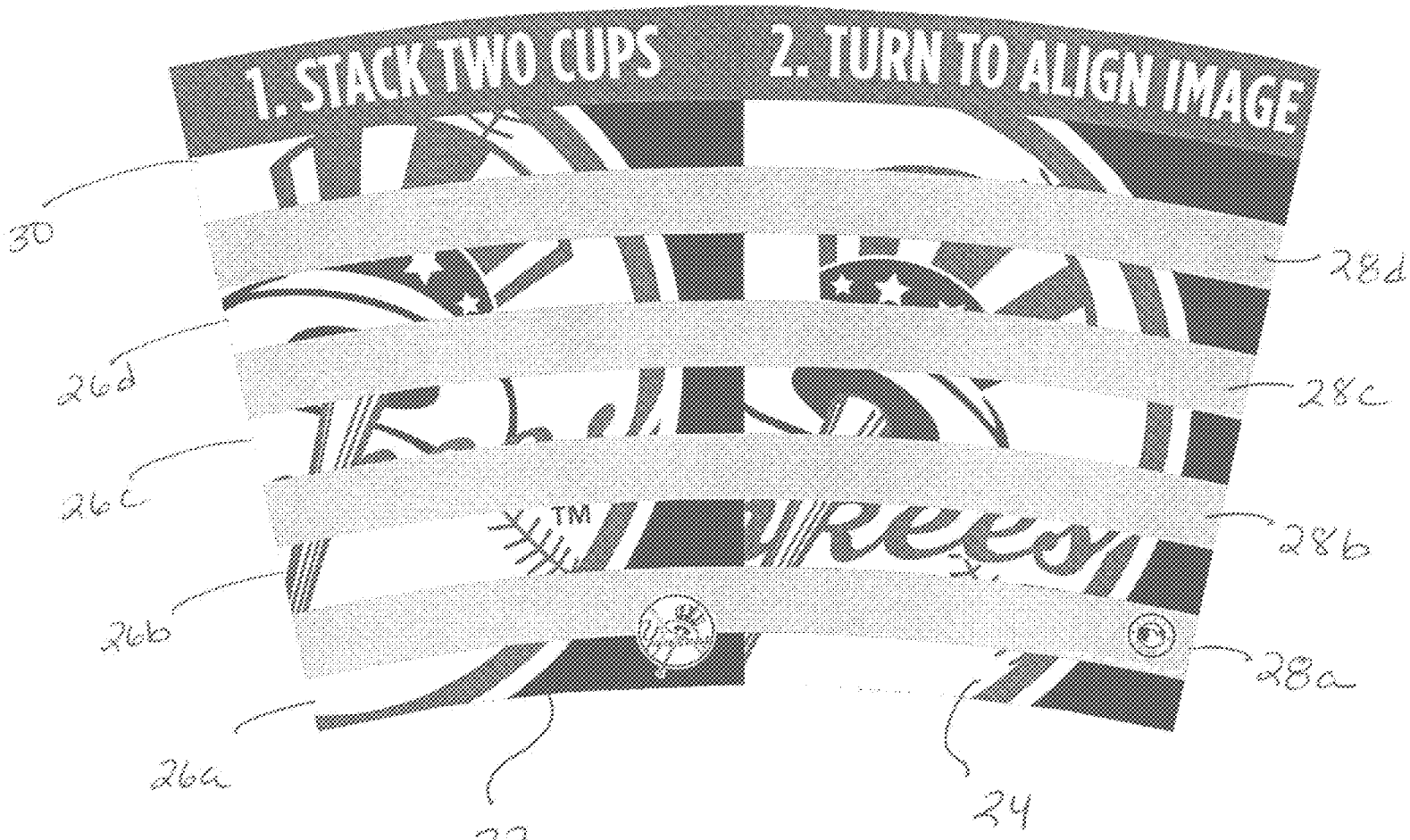
FIG. 8 is a 2D depiction of the sidewall of the cup of FIG. 1 with the transparent areas shown in light gray.
Figure 9:
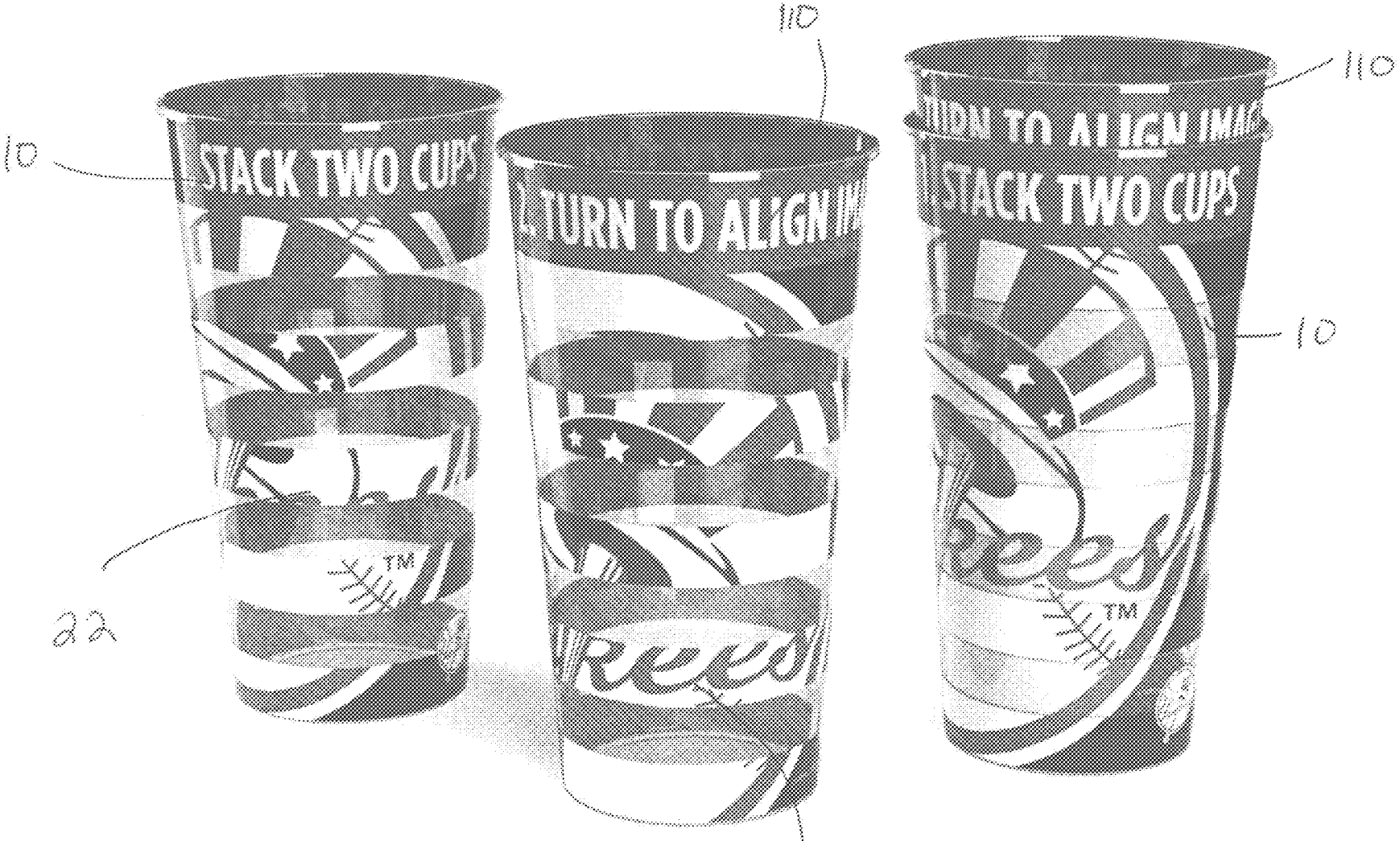
FIG. 9 is a perspective view showing two of the cups of FIG. 1 side by side with the front side of the bottom cup showing and the rear side of the top cup showing, and showing the two cups in the stacked orientation of FIG. 6.

As best shown in FIGS. 7-9, images 32*a*, 32*b* are visible in composite form on front half 22 and rear half 24 respectively of first cup 10 when first and second cups 10, 110 are stacked and oriented such that front half 22 of first cup 10 is aligned in overlapping fashion with rear half 124 of second cup 110. As best seen in FIG. 7, images 32*a*, 32*b* include portions of the same design but the designs are vertically offset such that image 32*a* has a lower design portion that is not shown in image 32*b* and image 32*b* has an upper design portion that is not shown in image 32*a*. The designs are offset a distance that is approximately equal to the displacement distance x between first and second cups 10, 110 when they are stacked.

As best seen in FIG. 8, each graphic ring 26*a*, 26*b*, 26*c*, 26*d* includes a part of image 32*a* along the front half 22 of sidewall 14 and includes a part of image 32*b* along the rear half 24 of sidewall 14. The part of each image 32*a*, 32*b* included in each ring is that part of the image that corresponds in size, shape and positioning with the graphic rings as they appear on sidewall 14. Thus, the lowest part of each image is displayed in the front and rear halves 22, 24 respectively of the lowermost graphic ring 26*a*. The parts of each image 32*a*, 32*b* that are missing or not included in the front and rear sidewall respectively are those parts that correspond in size, shape and positioning with the transparent rings 28*a*, 28*b*, 28*c*, 28*d* as they appear on sidewall 14. Because of the offset nature of the images, the parts of image 30*b* included in the graphic areas in the rear half 24 are the parts of the image 30*a* that are missing from the graphic areas in the front half 22. In addition, graphic areas 26*b*, 26*c* and 26*d* in front half 22 contain parts of image 32*a* that are also parts of image 32*b*. Similarly, graphic areas 26*a*, 26*b* and 26*c* in rear half 24 contain parts of image 32*b* that are also parts of image 32*a*. In this manner, when the second identical cup 110 is seated within the first cup 10 in a stacked configuration and turned such that the front half 22 of first cup 10 is aligned and overlapping the second half 24 of second cup, the graphic areas of the second cup 110 are visible through the transparent areas of the first cup 10 and combine with the graphic areas of the first cup 10 to display images 32*a* and 32*b* in composite form.

Upper circumferential banner 30 also includes design elements corresponding to the upper part of images, 32*a*, 32*b* including indicia with instructions to the user to insert one cup into the other and turn the inserted second cup, or rotate the second cup with respect to the first cup, until the design elements are aligned to form the complete images. The second cup is inserted into the first cup and rotated such that rear half 124 of the sidewall of second cup 110 is aligned with and overlapped by front half 22 of first cup 10, and front half 122 (not shown) of the second cup 110 is aligned with and overlapped by rear half 24 of first cup 10.

While images 30*a*, 30*b* consist of a logo design with wording and artwork, it should be understood that the image or images to be displayed in composite form (and the parts of each image to be included in the graphic areas) may consist of any visual elements, including letters, words, colors, patterns, designs, artwork, graphics, photographs and combinations thereof. Parts of the images may be replicated in the graphic areas using any means known in the art for printing or otherwise incorporating graphics onto a substrate, including via in-mold label, dry-offset print, direct digital print, heat transfer, screen print, and hot stamp.

Cup 10 may be made from any material suitable for forming a cup sidewall having transparent areas and graphic areas. For purposes of this invention, the transparent areas may be made of any material that is sufficiently transparent such that the designs on an underlying graphic area can be seen through the transparent area. An acceptable material for purposes of the invention is a clarified polypropylene material which is generally transparent in nature and can be printed to create the graphic areas. Other acceptable means for printing the materials include, without limitation, polystyrene, acrylic, polycarbonate and styrene acrylo nitrile. In one embodiment, a clarified polypropylene material is provided in the form of a transparent sheet and the graphic areas 26*a*, 26*b*, 26*c*, 26*d* are printed with the applicable parts of images 32*a*, 32*b* via offset printing techniques. The printed sheet or label is then cut and placed into a form with the ends of the sheet abutting to form a seam dividing the front half 22 from the second half 24 along one side of the cup. The sheet or label is then incorporated into the sidewall of the cup using in mold labeling techniques as is well known in the art.

While cup 10 as described includes a series of design and transparent rings extending around the side wall of the cup with the parts of two images included on the two halves of the sidewall respectively, it should be understood that a variety of different configurations or patterns of design areas and transparent areas can be used without departing from the invention. For example, rather than rings or strips, portions of one or more images may be included in different shapes of graphic areas such as squares or circles with correspondingly shaped transparent areas. In addition, more than two images may be displayed around the cup by including design and transparent areas in more sections along the sidewall. For example, the sidewall may include four quadrant sections wherein at least one design area and at least one transparent area positioned above the design area is included in each quadrant section. A series of images may then be displayed along the sidewall in composite form when a second cup is positioned within the first cup in a manner that aligns graphic and transparent portions from different sections of each cup.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A decorative cup that displays at least one composite image when a second cup is received within the decorative cup in a stacked configuration, said cup comprising:

a sidewall extending from a closed bottom to an open top wherein said sidewall comprises:

a first section comprising at least one first section graphic area and a first section transparent area positioned above the at least one first section graphic area, wherein the at least one first section graphic area comprises a lower part of an image;

a second section comprising at least one second section graphic area, wherein the at least one second section graphic area comprises an upper part of the image and wherein the first section transparent area is positioned a distance higher than the second section graphic area in an amount approximately equal to a displacement distance between the sidewall and a sidewall of a second cup when the second cup is seated within the decorative cup in a stacked configuration.

2. The cup of claim 1, wherein the first section comprises a first half of the sidewall and the second section comprises a second half of the sidewall divided along a longitudinal axis extending from the closed bottom to the open top of said sidewall.

3. The cup according to claim 2, wherein each of said at least one first section graphic area is combined with a corresponding one of said at least one second section graphic area to form a circumferential ring extending transversely around said sidewall.

4. The cup according to claim 3, wherein each of said at least one first section transparent area forms a circumferential ring extending transversely around said sidewall.

5. A cup according to claim 1, wherein said first section comprises a plurality of first section graphic areas extending one above the other along said first section with a plurality of first section transparent areas extending adjacent to and above corresponding graphic areas.

6. A cup according to claim 5, wherein said second section comprises a plurality of second section graphic areas extending one above the other along said second section with a plurality of transparent areas extending adjacent to and above corresponding graphic areas.

7. A cup according to claim 6, wherein each of said plurality of first section graphic areas and said plurality of first section transparent areas have a height approximately equal to said displacement distance.

8. A cup according to claim 6, wherein each of said plurality of first section and second section graphic areas and each of said plurality of first section and second section transparent areas have a height approximately equal to said displacement distance.

9. A cup according to claim 5, wherein said plurality of first section graphic areas are each aligned with a corresponding one of said plurality of second section graphic areas to define a plurality of circumferential graphic rings around the sidewall.

10. A cup according to claim 9, wherein said plurality of first section transparent areas are each aligned with a corresponding one of said plurality of second section transparent areas to define a plurality of circumferential transparent rings around the sidewall.

11. A cup according to claim 10, wherein each of said plurality of circumferential graphic rings and circumferential transparent rings have a height approximately equal to said displacement distance.

* * * * *